US010385639B2

(12) United States Patent
Hered

(10) Patent No.: US 10,385,639 B2
(45) Date of Patent: Aug. 20, 2019

(54) APPARATUS AND METHOD FOR UTILIZING REFLECTED WAVES IN A FLUID TO INDUCE VIBRATIONS DOWNHOLE

(71) Applicant: William A. Hered, Houston, TX (US)

(72) Inventor: William A. Hered, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 581 days.

(21) Appl. No.: 14/947,078

(22) Filed: Nov. 20, 2015

(65) Prior Publication Data

US 2017/0145769 A1 May 25, 2017

(51) Int. Cl.

| | |
|---|---|
| ***E21B 31/00*** | (2006.01) |
| ***E21B 34/06*** | (2006.01) |
| ***E21B 47/00*** | (2012.01) |

(52) U.S. Cl.

CPC ..... *E21B 31/005* (2013.01); *E21B 34/06* (2013.01); *E21B 47/00* (2013.01)

(58) Field of Classification Search

USPC ..... 166/301

See application file for complete search history.

(56) References Cited

U.S. PATENT DOCUMENTS 5,009,272 A 4/1991 Walter
6,502,638 B1 * 1/2003 Stoesz ..... E21B 31/005 166/177.6
7,575,051 B2 8/2009 Stoesz et al.
2004/0011564 A1 1/2004 Eddison
2005/0257931 A1 * 11/2005 Mody ..... E21B 31/005 166/301

OTHER PUBLICATIONS

PCT International Search Report and Written Opinion; International Application No. PCT/US2016/057461; International Filing Date: Oct. 18, 2016; dated Jan. 20, 2017; pp. 1-16.

* cited by examiner

*Primary Examiner* — Matthew R Buck
*Assistant Examiner* — Patrick F Lambe
(74) *Attorney, Agent, or Firm* — Cantor Colburn LLP

(57) ABSTRACT

In one aspect, an apparatus for inducing vibrations in an object in a wellbore is disclosed that in one embodiment includes a tubular conveyable in the wellbore and has at its bottom end an engagement tool that is configured to engage with or latch onto the object. A first flow control device, such as a cycling valve, in the tubular cycles (closes and opens) at a selected frequency or rate and generates at each closing a first upward pressure pulse in a fluid flowing through the tubular and a downward pressure pulse in the fluid, which induces a first force in the engagement tool and thus in the fish engaged with the engagement tool. A second flow control device, above the first flow control device in the tubular, closes in response to the first upward pressure pulse during each cycle and generates a second upward pressure pulse in the fluid flowing through the tubular and a second downward pressure in the fluid and a corresponding second force in the object. The selected frequency may be set to match a resonant frequency of the tubular. The first flow control device may be cycled to close on or before arrival of the second downward pulse at the first flow control device to generate a resonance in the tubular.

18 Claims, 1 Drawing Sheet

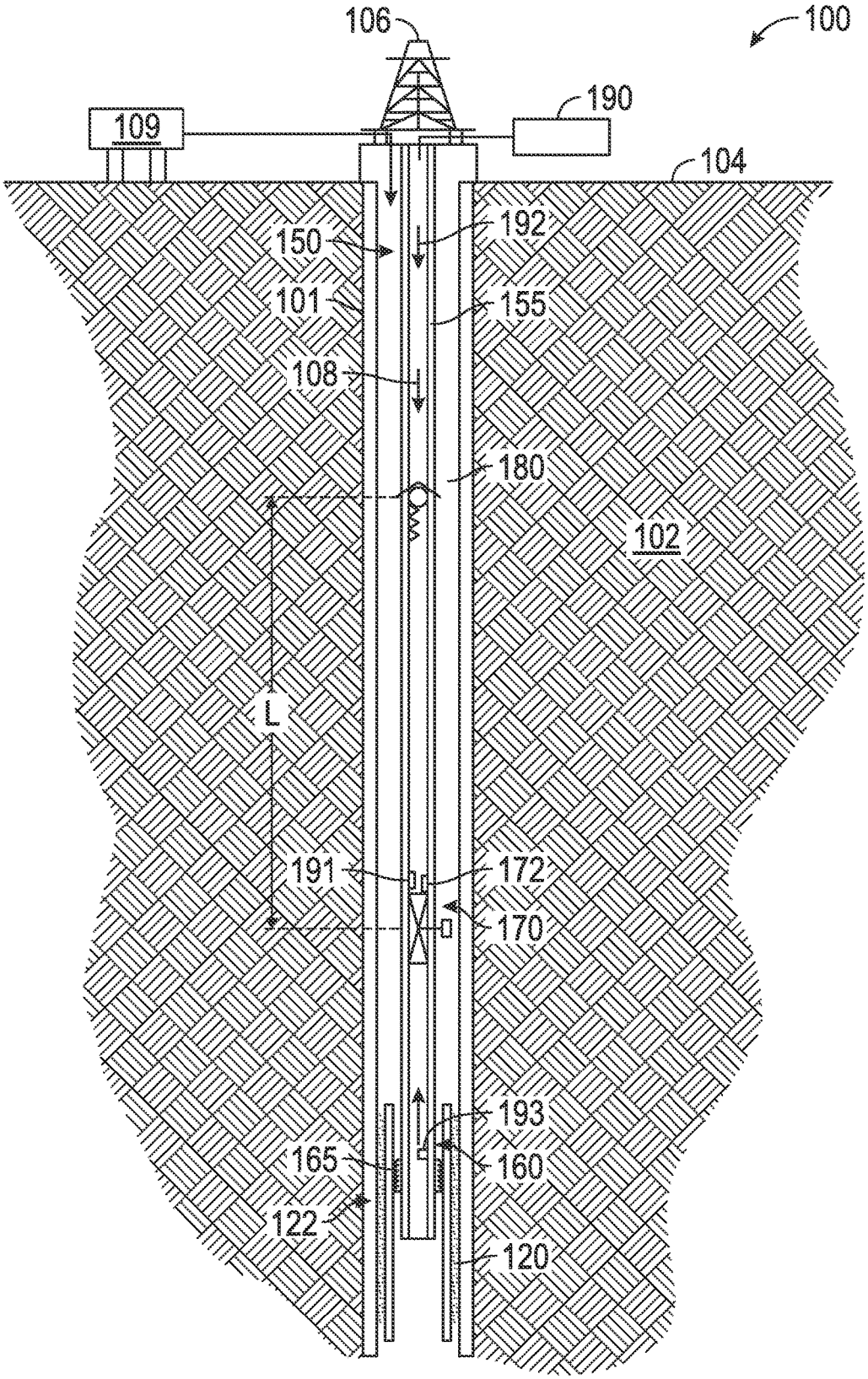
106
100
190
109
104
192
150
101
155
108
180
102
L
191
172
170
193
165
160
122
120

APPARATUS AND METHOD FOR UTILIZING REFLECTED WAVES IN A FLUID TO INDUCE VIBRATIONS DOWNHOLE

BACKGROUND

1. Field of the Disclosure

This disclosure relates generally to apparatus and methods utilizing reflected waves in a fluid to induce vibrations downhole.

2. Background of the Art

Wellbores are drilled in subsurface formations for the production of hydrocarbons (oil and gas). Modern wells can extend to great well depths, often more than 15,000 ft. A wellbore is typically lined with casing (a string of metal tubulars connected in series) along the length of the wellbore to prevent collapse of the formation (rocks) into the wellbore. A number of operations are performed in the cased or open hole to prepare the wellbore for the production of hydrocarbons. Sometimes a device or a portion of a tool conveyed in the wellbore becomes trapped or stuck in the wellbore. The trapped device is often referred to as a "fish". A variety of dislodging or fishing tools have been utilized to dislodge the trapped objects. Such tools are conveyed into the wellbore by a tubular and attached to the fish to dislodge the fish. Experiments have demonstrated that relatively low forces at higher frequencies are a more effective approach in retrieving a fish than traditional methods such as overpulling or jarring. These conventional methods, in pulling a sand-lodged fish, can cause the sand grains to interlock and thereby wedge the fish more firmly in the wellbore.

The disclosure herein provides apparatus and methods that can transmit high frequency energy pulses to the fish, regardless of the depth at which the fish is lodged.

SUMMARY

In one aspect, an apparatus for dislodging a trapped or stuck object (fish) in a wellbore is disclosed that in one embodiment includes a tubular conveyable in the wellbore and has at its bottom end an engagement tool that is configured to engage with or latch onto the fish. A first flow control device, such as a cycling valve, in the tubular cycles (closes and opens) at a selected frequency or rate and generates at each closing a first upward pressure pulse in a fluid flowing through the tubular and a downward pressure pulse in the fluid, which induces a first force in the engagement tool and thus in the fish engaged with the engagement tool. A second flow control device, above the first flow control device, in the tubular closes in response to the first upward pressure pulse during each cycle and generates a second upward pressure pulse in the fluid flowing through the tubular and a second downward pressure in the fluid and a corresponding second force in the fish. Successive inducement of the first and second force in the fish generates vibrations in the fish. The selected frequency may be set to match a resonant frequency of the tubular. The first flow control device may be cycled to close on or before arrival of the second downward pulse at the first flow control device to generate a resonance in the tubular.

In another aspect, a method of dislodging a fish in a wellbore is disclosed that in one non-limiting embodiment includes: conveying a service string into the wellbore, wherein the service string includes an engagement tool at a bottom end of a tubular configured to engage with the fish, a first flow control device in the tubular above the engagement tool, and a second flow control device above the first flow control device. Engaging the engagement device with the fish, supplying a fluid into the tubular from a surface location, and cycling the first flow control device at a selected frequency generates during each cycle a first upward pressure pulse and a first downward pressure pulse in the fluid flowing through the tubular to induce a first force in the fish and wherein the second flow control device closes in response to the first upward pressure pulse to generate a second upward pressure pulse and a second downward pressure in the fluid flowing through the tubular to induce a second force in the fish.

Examples of the more important features of certain embodiments and methods according to this disclosure have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein:

FIG. 1 shows a line diagram of a system that includes at least two flow control devices in a tubular to generate vibrations in an object downhole, according to a non-limiting embodiment of the disclosure herein.

DETAILED DESCRIPTION

In aspects, the apparatus and methods for dislodging a fish disclosed herein utilizes the dynamic compressibility of the fluid in the string carrying the dislodging tool to operate. In one non-limiting embodiment, a string that has an engagement device at a bottom end of tubular is conveyed in the well and the engagement device is latched onto the fish. A fluid is circulated through the tubular during the process of disengaging of the fish. The string includes a first flow control device placed a selected distance below a second flow control device in the tubular, both above the engagement device. The first flow control device can be cycled (closed and opened) at desired frequencies and is placed close to the engagement device, and thus proximate to the fish. In one embodiment, the first flow control device is configured to close temporarily and abruptly block the fluid flowing through the tubular. When the first flow control device closes, it creates a downward force that acts on the tubular and thus on the fish. Closing of the first flow device also generates (induces) a pressure pulse in the fluid that travels upward in the tubular at the speed of the sound in the fluid flowing though the tubular. The second flow control device may be a biased check valve that allows the fluid in the tubular to flow in the downhole direction. When the upward traveling pressure pulse generated by the first flow control device reaches the check valve, it causes the valve to close, thereby inducing an upward pressure on the tubular and thus on the fish, Closing of the check valve reflects the pressure pulse so that it travels downward toward the first flow control device. The downward traveling pressure pulse can then be caught by the first flow control device by closing such device on or before such pressure pulse arrives at the first flow control device. The frequency of forces acting on the fish can therefore be controlled by varying the closing and opening speed of the first flow control device. In one embodiment, the frequency is set to match a resonant frequency of the tubular so that maximum energy is be transmitted to the fish. In one embodiment, the spacing between the first and second flow control devices is set such that the pressure pulses are reflected back and forth between the first and second flow control devices, creating a second form of resonance in the string.

FIG. 1 shows a system 100 for retrieving an object ("fish") stuck in a wellbore 101 formed in formation 102 from a surface location 104. An object (fish) 120 is shown stuck in the wellbore at a downhole location 122. The fish 120 may be any device or tool that is stuck in the wellbore. The object may be stuck in sand or otherwise during drilling of the wellbore, completion of the wellbore or during production or remedial operations. To retrieve the object 120, a service string 150 from a rig 106 at the surface 104 is conveyed in the wellbore 101. In one non-limiting embodiment, the service string 150 includes a pipe or tubular 155 that has an engagement tool 160 attached at its bottom end. The engagement tool 160 may include an engagement device 165 that latches onto the object 120. A variety of engagement tools are commonly used for fishing operations. Any suitable engagement tool that makes physical contact with the stuck object 120 may be utilized for the purposes of this disclosure. Often, the object is stuck in sand and the engagement device 160 is used to loosen the fish 120 from the sand and then pulled up to retrieve it from the wellbore.

The system 100 is a vibrating system in which the engagement tool 160 applies tensile and compressive loads to a stuck fish 120. The string 150 further includes a flow control device 170 in the tubular 155 that cycles (alternately closes and opens) to block a fluid 108 flowing through the tubular 155 to generate pressure pulses in the fluid 108. The cycling flow control device 170 may be any suitable device, including, but not limited to a gate valve, ball, poppet valve or any other hydraulically or electrically controlled device. A controller 190 at the surface and/or a controller 191 downhole may be provided to control the cycling or frequency of the flow control device 170. The string 150 further includes another flow control device 180 that closes in response to pressure pulses generated by the flow control device 170. In one embodiment, the flow control device 180 is a check valve that is biased to allow the fluid 108 to flow downward, but block the fluid through the tubular when a pulse generated by the flow through device 170 reaches the check valve 180. The check valve 180 is placed a distance "L" above or uphole of the cycling valve 170.

To dislodge the fish 120, the string 150 is conveyed into the wellbore 101 and the engagement device 165 latches onto or grasps the stuck fish 120. At this point, a tensile or compressive preload may be applied to the fish 120. The fluid 108 is then supplied from a surface supply unit 109 into the tubular 155, which circulates fluid through the wellbore 101. The flow control device 170 is then cycled (closed and opened at a selected rate or frequency). When the flow control device closes, it generates a positive pressure pulse or wave 170 in the fluid 108 that travels uphole or upward through the fluid 108 in the tubular at the speed of sound in the fluid 108 and acts on the fish 120 via the engagement tool 160. The flow control device 170 then opens to allow the fluid 108 to pass as the positive pressure pulse continues to move upward. When the positive pressure pulse reaches the biased check valve 180, the difference in pressure causes the check valve 180 to close, which reflects the pressure pulse back downward toward the cycling valve 170 and the fish 120. This reversal of the pressure pulse or wave also generates an upward force on the engagement tool. Thus, each time the cycling valve 170 closes and each time the check valve 180 closes, a force is applied to the fish via the engagement tool 160.

By timing the intervals between closures of the cycling valve 170 to the distance "L" that the positive pressure pulse travels, the cycling valve can be designed to close as the downward moving pulse reaches the cycling valve. In this configuration, the generated pulses would superimpose each cycle, building into a semi-resonant state. In addition, upward and downward forces created by the pressure pulses on the valves 170 and 180 can be timed to approach the natural frequency of the string itself. This would cause the mass of the tubular itself to also enter a semi-resonant state. The effect of this would be a system of alternating forces at relatively high amplitudes and frequencies compared to existing fish retrieval methods. In one embodiment, the spacing "L" between the first flow control device 170 and the second flow control device 180 may be defined as $L=CT/2$, where C is the speed of sound in the fluid 108 in the tubular 155 and T is period of cycling of the first flow control device 170. In this configuration, the frequency "f" of the flow control device 170 will be defined by $f=1/T$.

Thus, the system 100 may include a tubular 155 conveyable in the wellbore that has an engagement tool at a bottom end of a tubular that is configured to engage with the fish. A first flow control device in the tubular 155 cycles at a selected frequency to generate during each cycle a first upward pressure pulse in the fluid 108 flowing downward through tubular 155 to induce a first force in the fish and a second flow control device 180 above the first flow control device 170 closes in response to the first upward pressure pulse during each cycle and induces a second force in the fish and a downward pressure pulse or reflective pulse in the fluid 108 flowing downward through the tubular 155. In one embodiment, the selected frequency is a resonant frequency of the tubular and the spacing $L=CT/2$ and the selected frequency $f=1/T$. In another aspect, the first flow control device 170 closes on or before the downward pressure pulse generated by the second flow control device 180 arrives at the first control device 170, to create a secondary resonance in the tubular 155. The first flow control device may be a gate valve, ball, poppet valve, a hydraulically operated or controlled device or an electrically operated or controlled device. In another aspect, the first flow control device 170 may include a hydraulic switch that adjusts the cycling frequency of the first flow control device 170 in response to flow rate of the fluid 108 through the tubular 155. In another aspect, the system may further include a controller 190 at the surface or a controller 191 that alone or in combination adjusts the frequency of cycling of the first flow control device 170 in response to input from a sensor 172 relating to a downhole condition and/or a condition relating to the fish 120. Examples of applicable sensors include, but are not limited to: accelerometers, strain gauges, and pressure sensors. In another aspect, the controller 190 and/or may cycle the first flow control device 170 at a frequency that generates resonance in the tubular 155. In other aspects, the first flow control device may be a valve that is controlled by the controller 191 directly or by e controller 190 via: a line 191 that may be an electrical line or a fiber optic line; a wireless signal 192 that may be an acoustic signal or an electromagnetic signal; or a pressure pulse signal. In another aspect, the controller 190 and/or 191 may adjust or control the cycling frequency of the first flow control device in response to sensor 193 relating a condition or parameter relating to the fish. The sensor 193 may transmit signals to the controller 191 directly or to controller 190 by an electrical conductor, a fiber optic line, a pressure pulse or wirelessly.

The foregoing disclosure is directed to the certain exemplary embodiments and methods of a cut and pull tool. Various modifications will be apparent to those skilled in the art. It is intended that all such modifications within the scope of the appended claims be embraced by the foregoing disclosure. The words "comprising" and "comprises" as used in the claims are to be interpreted to mean "including, but not limited to". Also, the abstract is not to be used to limit the scope of the claims.

The invention claimed is:

1. An apparatus for inducing vibrations in a fish in a wellbore, comprising:

a tubular conveyable in the wellbore that includes an engagement tool at a bottom end of the tubular configured to engage with the fish;

a first flow control device at a location in the tubular that performs a cycle of closing and opening of the tubular to generate during a first upward pressure pulse in a fluid flowing through the tubular, wherein performing the cycle induces a force in the fish; and a second flow control device at a location in the tubular uphole of the first flow control device that closes in response to receiving the first upward pressure pulse to reflect the first upward pressure pulse, thereby generating a downward pressure pulse in the fluid flowing through the tubular induces a force in the fish;

wherein the first flow control device is timed to close as the downward pressure pulse arrives at the first control device to generate a second upward pressure pulse, wherein superposition of the second upward pressure pulse and the downward pressure pulse at the first flow control device induces a force on the fish.

2. The apparatus of claim 1, wherein the first flow control device performs the cycle at selected frequency that is a resonant frequency of the tubular.

3. The apparatus of claim 1, wherein spacing "L" between the first flow control device and the second flow control device is defined by: L=CT/2, where C is the speed of sound in the fluid in the tubular and T is a period of cycling of the first flow control device.

4. The apparatus of claim 1, wherein the first flow control device is selected from a group consisting of a: gate valve; ball; solenoid; and poppet valve.

5. The apparatus of claim 1, wherein the first flow control device includes a hydraulic switch that adjusts a frequency of cycling of the first flow control device in response to flow rate of the fluid flowing through the tubular.

6. The apparatus of claim 1 further comprising a controller that adjusts a frequency of cycling of the first flow control device in response to a sensor input relating to a downhole condition or a condition of the fish.

7. The apparatus of claim 1, wherein the controller cycles the first flow control device at a resonant frequency of the tubular.

8. The apparatus of claim 1, wherein the second flow control device is a check valve that allows a downward flow of fluid through the tubular.

9. The apparatus of claim, 1, wherein the first flow control device is an electrically-controlled valve that is activated by a signal that is one of: sent via an electrical conductor; sent via a fiber optic line; sent as a wireless signal; sent as a pressure pulse through a fluid in the tubular.

10. A method of generating vibrations in a fish in a wellbore, comprising:

conveying a service string into the wellbore, wherein the service string includes an engagement tool at a bottom end of a tubular configured to engage with the fish, a first flow control device at a location in the tubular uphole of the engagement tool and a second flow control device a location in the tubular above the first flow control device;

engaging the engagement device with the fish and supplying a fluid into the tubular from a surface location; and cycling the first flow control device to generate a first upward pressure pulse in the fluid flowing through the tubular to induce a first force in the fish and wherein the second flow control device closes in response to the first upward pressure pulse to generate a downward pressure pulse in the fluid flowing through the tubular to induce a second force in the fish; and closing the first flow control device as the downward pressure pulse arrives at the first control device to generate a second upward pressure pulse, wherein superposition of the second upward pressure pulse and the downward pressure pulse at the first flow control device induces a third force on the fish.

11. The method of claim 10, wherein the first flow control device cycles at a selected frequency that is a resonant frequency of the tubular.

12. The method of claim 10, wherein spacing "L" between the first flow control device and the second flow control device is defined by: L=CT/2, where C is the speed of sound in the fluid in the tubular and T is period of cycling of the first flow control device.

13. The method of claim 10, wherein the first flow control device is selected from a group consisting of a: gate valve; ball; solenoid; and poppet valve.

14. The method of claim 10, wherein the first flow control device includes a hydraulic switch that adjusts a frequency of cycling of the first flow control device in response to a flow rate of the fluid flowing through the tubular.

15. The method of claim 10 further comprising controlling a frequency of cycling of the first flow control device in response to a sensor input relating to a downhole condition or a condition of the fish.

16. The method of claim 10 further comprising setting a selected frequency of the first flow control device at a resonant frequency of the tubular.

17. The apparatus of claim 10, wherein the second flow control device is a check valve that allows a downward flow of fluid through the tubular.

18. The apparatus of claim 10, wherein the first flow control device is an electrically-controlled valve that is activated by a signal that is one of: sent via an electrical conductor; sent via a fiber optic line; sent as a wireless signal; sent as a pressure pulse through a fluid in the tubular.

* * * * *